US005292260A

United States Patent [19]

Sinisi et al.

[11] Patent Number: 5,292,260

[45] Date of Patent: Mar. 8, 1994

[54] BALLAST CONNECTOR FOR LIGHTING FIXTURE

[75] Inventors: David B. Sinisi; Carolyn S. Sinisi, both of Harrisburg; Robert H. Frantz, Newville, all of Pa.

[73] Assignee: The Whitaker Corporation, Wilmington, Del.

[21] Appl. No.: 6,888

[22] Filed: Jan. 21, 1993

[51] Int. Cl.[5] ..... H01R 13/00

[52] U.S. Cl. ..... 439/441

[58] Field of Search ..... 439/436–441

[56] References Cited

U.S. PATENT DOCUMENTS

| | | | |
|---|---|---|---|
| 4,705,482 | 11/1987 | Endo et al. | 439/460 |
| 4,729,740 | 3/1988 | Crowe et al. | 439/76 |
| 4,981,432 | 1/1991 | Kikuchi | 439/417 |

*Primary Examiner*—Joseph H. McGlynn
*Attorney, Agent, or Firm*—William B. Noll

[57] ABSTRACT

This invention is directed to an electrical connector, particularly an electrical ballast connector, that offers a reliable means preferably to extract electrical conductors therefrom. The connector comprises a dielectric housing having a plurality of cavities therein extending between a contact loading face and a conductor receiving face, where the conductor receiving face includes an aligned row of conductor openings of a like plurality, where each opening includes a lateral slot in communication with the cavities. A stamped electrical contact is provided within each cavity, where said contact includes a base and a pair of spaced apart arms upstanding therefrom, where the inner edge of a first arm is aligned with its corresponding conductor opening, and the other arm includes an angular extension directly downwardly and toward the first arm. The end most edge of the other arm is aligned with and exposed to its corresponding conductor opening, and at least a portion of the angular extension is exposed to its corresponding lateral slot, whereby an extraction member may be received in the lateral slot to laterally flex or pivot the angular extension to provide a free path for the electrical conductor so as to remove the electrical conductor from contact with said inner edge. Finally, antioverstressing means are provided to limit the flexing or pivotal action of the angular extension.

9 Claims, 8 Drawing Sheets

BALLAST CONNECTOR FOR LIGHTING FIXTURE

RELATED APPLICATION

The invention hereof is related to the invention covered in Ser. No. 08/007,319, filed Jan. 21, 1993.

BACKGROUND OF THE INVENTION

This invention is directed to an electrical connector, particularly an electrical ballast connector of the type for use with fluorescent light fixtures, where there is a need to readily and reliably insert and extract electrical conductors therefrom.

Fluorescent electrical ballasts are used in areas where fluorescent lighting is present, and are typically located within or behind the fluorescent light fixture. Typically, the electrical ballast comprises a long rectangular metal box or "can" with the electrical components mounted inside. A sealer or "potting compound" is then poured into the can which hardens to seal the electrical components within the can. Also typical is to have several discrete wires projecting through the potting material for electrical interconnection thereto. Typically the fluorescent fixture includes complementary discrete wires for interconnection to the discrete wires of the ballast.

The industry which manufactures electrical ballasts has recently begun mounting the components on printed circuit boards to eliminate the discrete wiring within the ballasts. The interior of the ballast is again potted to seal the components within the ballast housing. However, discrete wires still project through the potting for interconnection to the respective discrete wires of the wiring from the lighting fixtures. One such manufacturer has included an electrical connector at the end of the discrete wires for interconnection thereto by a mating electrical connector. The disadvantage to having an electrical connector at the end of the discrete wires is that typically the fluorescent fixtures are not sold with a mating electrical connector. Therefore, the manufacturer of the ballast has to include both connector halves which increases the cost of the electrical ballast. Furthermore, the installer of the ballast must not only replace the ballast but must also terminate the discrete wires of the lighting to the mating half of the electrical connector. When replacing the ballast, the user of the electrical light fixture must buy a ballast which also carries an electrical connector which is matable with the electrical connector of the first ballast installed. Otherwise, the electrical connector on the lighting fixture must also be replaced when the ballast is replaced.

U.S. Pat. No. 4,729,740 represents an improvement to the prior art attempts to achieve a risk free ballast connector and the foregoing problems associated with wiring same. The connector thereof includes a housing for receiving stripped conductors and a terminal mounted therein, where the terminal comprises a flat blade portion having a resilient, angled contact portion extending from one end thereof. The angled contact portion is directed away from the conductor receiving face of the housing so that as the stripped conductor is inserted into the housing the angled contact portion is biased upward but remains in electrical contact with the terminal. Unfortunately, the design of such connector offers no reliable means by which to extract the conductors from the housing. The present invention provides an easy and reliable means to load the conductors, and to extract same from the connector housing.

The advantages hereof will become apparent in the description which follows, particularly when read in conjunction with the drawings which follow.

SUMMARY OF THE INVENTION

The present invention is directed to an electrical connector of the type that may be used as a ballast connector for fluorescent light fixtures. The connector offers the advantages of a means for readily and reliably connecting and disconnecting discrete wires thereto. The connector comprises a dielectric housing having a plurality of cavities therein extending between a contact loading face and a conductor receiving face, where the conductor receiving face includes an aligned row of conductor openings of a like plurality, and at least one additional opening in communication with at least one of the cavities. Additionally, a stamped electrical contact or terminal is provided within each cavity, where the contact includes a base and a pair of spaced apart arms upstanding therefrom. The inner edge of a first arm is aligned with its corresponding conductor opening, and the other arm includes an angular extension directed downwardly and toward the first arm, where the end most edge thereof is aligned with and exposed to its corresponding conductor opening. At least a portion of the angular extension is exposed to the additional opening, whereby an extraction member may be received in the additional opening to laterally flex or pivot the angular extension to provide a free path for the electrical conductor so as to remove or insert the electrical conductor into contact with the inner edge. Finally, antioverstress means are provided to limit flexing of the electrical contact.

DETAILED DESCRIPTION OF PREFERRED EMBODIMENTS

The present invention relates to an electrical connector, such as may be used as a ballast connector for a lighting fixture, that offers to the installer an easy and reliable means to extract conductors therefrom. In the preferred embodiments, the connector housings have been designed to allow individual extraction of the conductors, or to allow extraction of all conductors in a single operation. While it should be understood that normal loading of the stripped conductors may be effected without assistance of an externally applied member, such member, as will be apparent hereinafter, may be used for loading.

Figure 5:
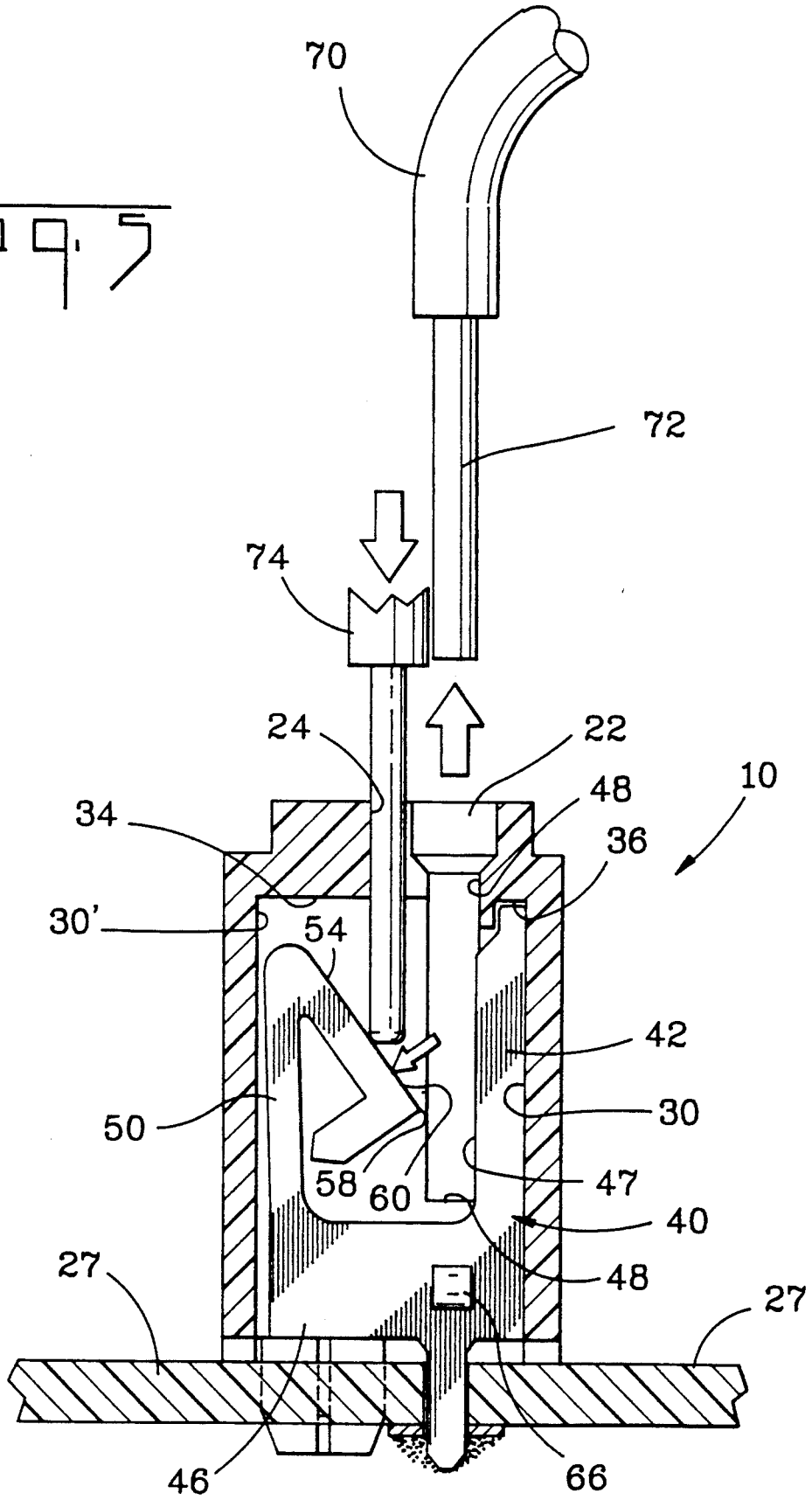
FIG. 5 is a partial sectional view of the assembly of FIG. 1, illustrating the position for extracting a stripped conductor in the connector housing.
Figure 6:
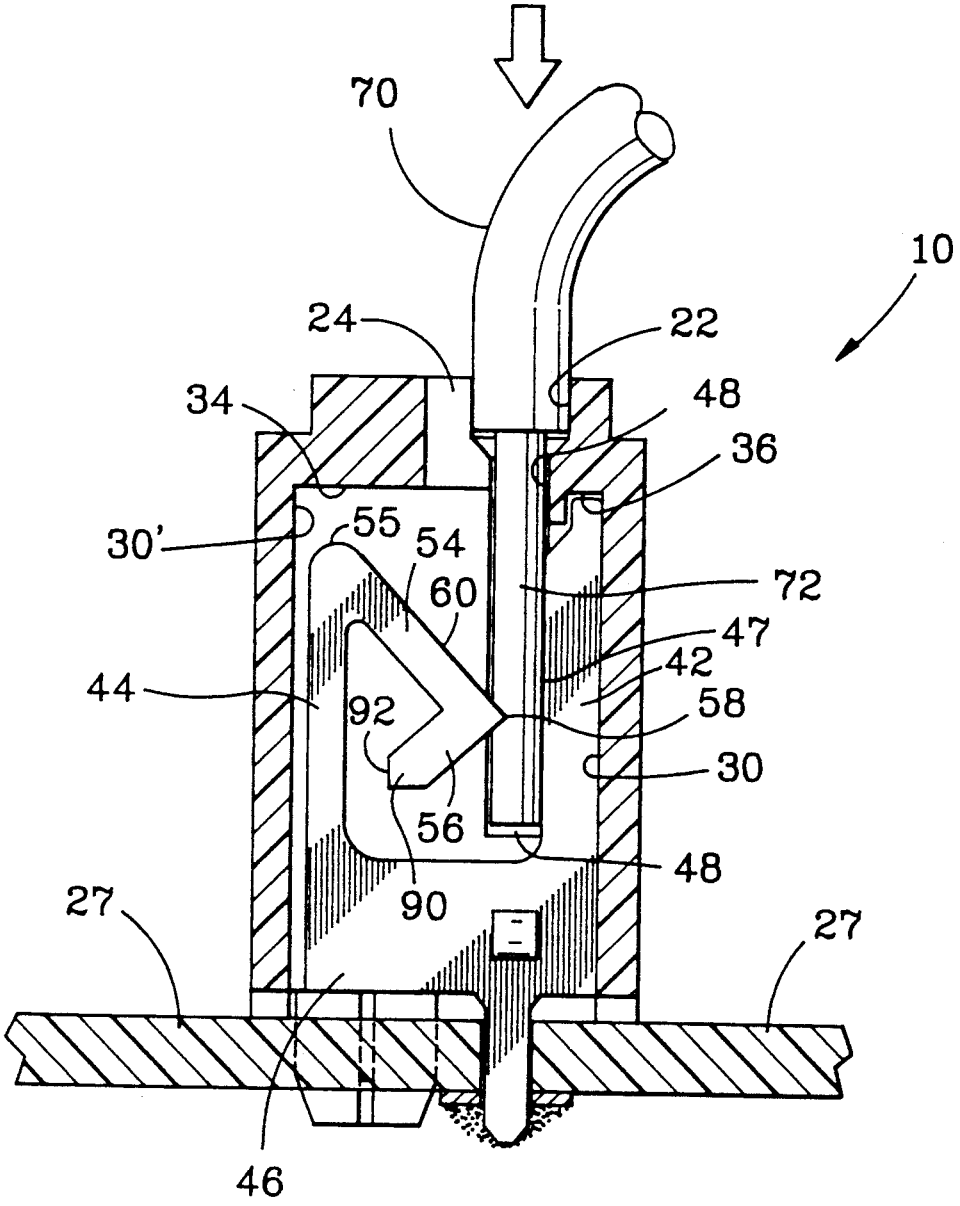
FIG. 6 is a partial sectional view similar to FIG. 5 showing the loaded connector.

FIGS. 1–8 represent the former embodiment. The connector 10 according to the invention comprises a housing 12, molded from a dielectric material, such as plastic, having a pair of side walls 14, a pair of end walls 16, a conductor loading face 18, and a terminal loading face 20. Along the conductor loading face 18 is a row of aligned openings 22, having slots 24 in communication with the interior thereof, as best illustrated in FIGS. 5 and 6. Projecting below from the terminal loading face 20 are a pair of alignment/mounting posts 26 for mounting to a printed circuit board (PCB) 27, as known in the art.

Interiorly, the housing 12 includes a plurality of narrow cavities 28, where the number of cavities is equal to the number of openings 22, namely, one cavity 28 for each opening 22, aligned therewith. Each cavity 28 is defined by a pair of side walls 30, 30' see FIG. 5, where a recess 32 has been provided in one of the cavity side walls 30. In a manner to be described hereinafter, the recess 32 is adapted to receive a locking lance struck from the body of the terminal, whereby to align and retain the terminal within the housing cavity. Finally, along the upper wall 34 of the cavity 28, a recess 36 may be provided near the opening 22, see FIG. 5, which provides stabilization to the terminal disposd within the cavity.

Figure 7:
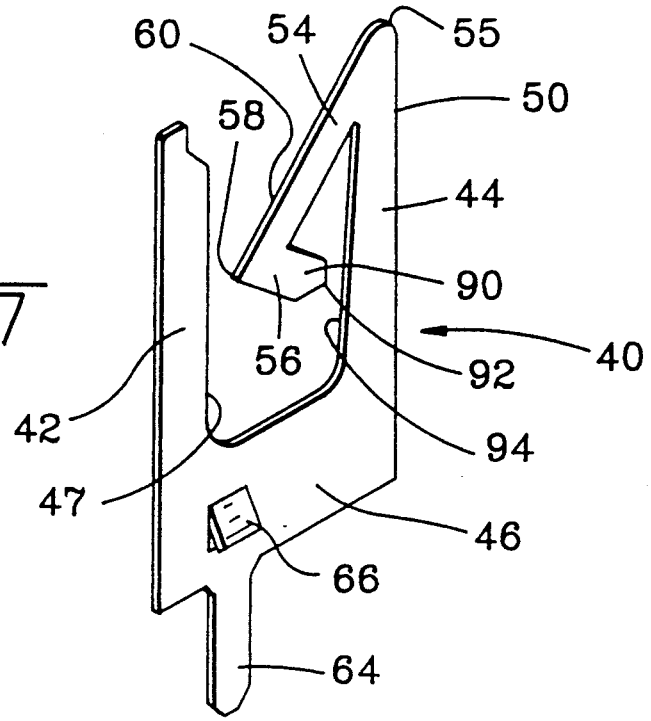
FIG. 7 is a perspective view of a preferred electrical terminal for use in the connector of this invention.

The preferred electrical terminal 40, illustrated in the terminal extracting position in FIG. 5, and free standing in FIG. 7, comprises an essentially planar member stamped from a blank of electrically conductive resilient material, such as metal. The terminal 40 includes a pair of major arms 42, 44 projecting upward from a base 46. A first major arm 42 is designed to lie adjacent the inside 30 of side wall 14 and within recess 36, which may be optional, and project toward the opening 22, where the edge 47 essentially coincides with the wall of slot 48 communicating with opening 22.

The second major arm 44 comprises a first leg 50 spaced from the opposite cavity wall 30', a second leg 54 angled downwardly from the end 55, and a third leg 56 angled from said second leg, where the intersection 58 defines a sharp point contact for the stripped conductor when loaded into the connector. It will be noted that the second leg 54 underlies the slot 24 and offers an angled surface 60 to said opening. Finally, projecting downwardly from the terminal base 46 is a PCB 27 engaging leg 64 for interconnection to a PCB by soldering, as known in the art. To align and secure the terminal within the cavity 28, a locking lance 66 may be struck from the base 46, for seating in recess 32 when the terminal is inserted into the housing cavity.

Figure 1:
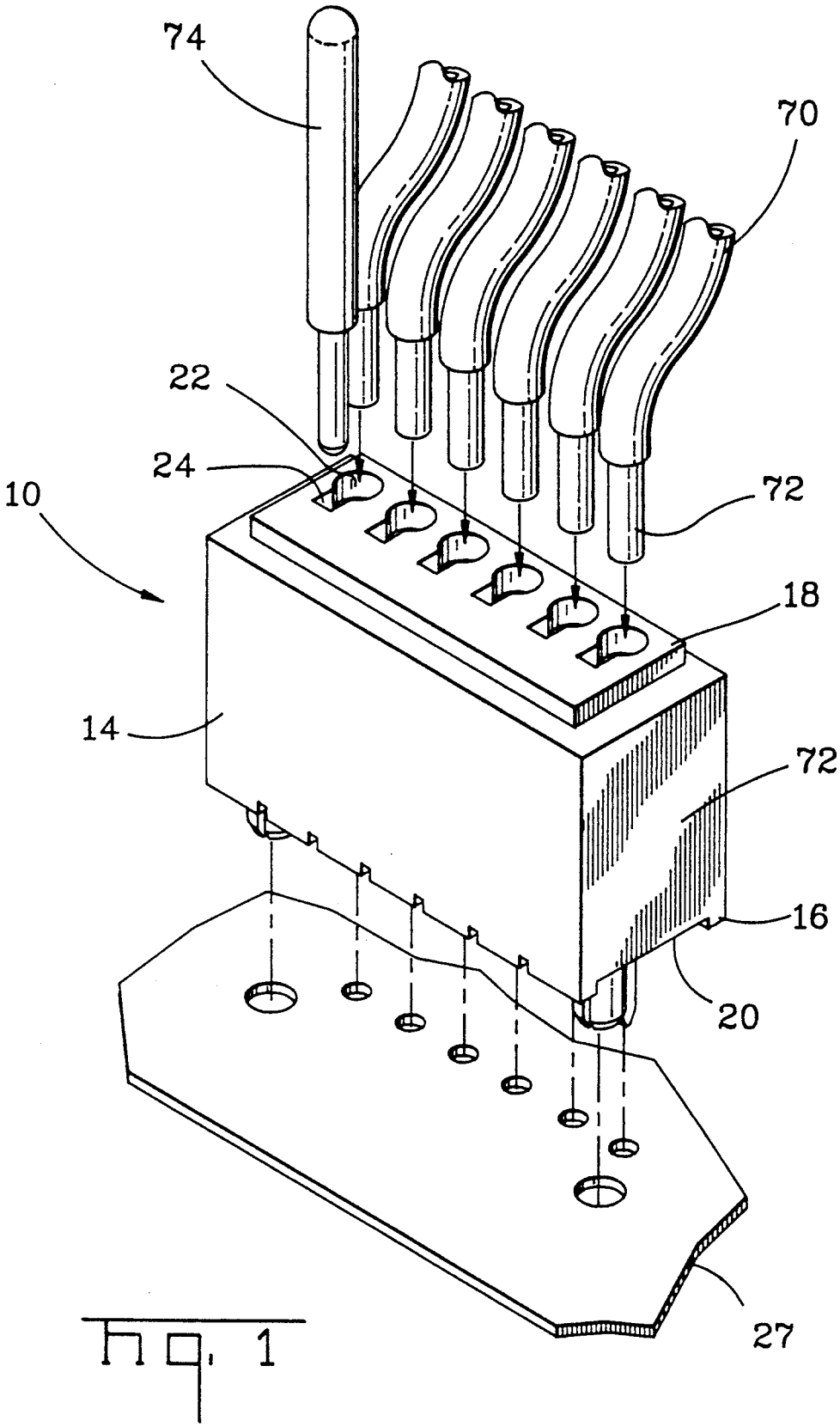
FIG. 1 is a perspective view of a preferred electrical connector according to this invention, showing a portion of a printed circuit board to which it may be mounted, and a plurality of stripped conductors prior to insertion therein, along with a representative tool to effect extraction of the stripped conductors.
Figure 2:
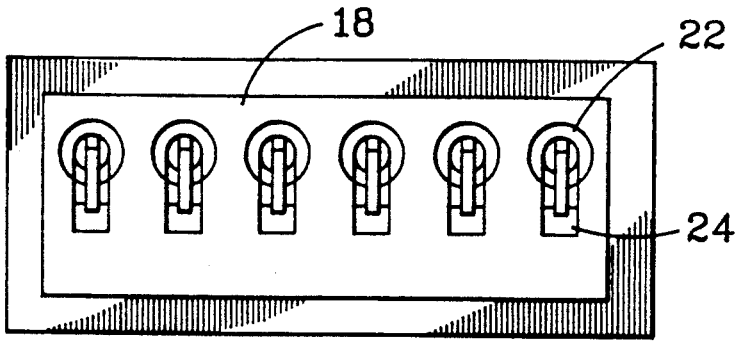
FIG. 2 is a top view of the electrical connector of FIG. 1.
Figure 3:
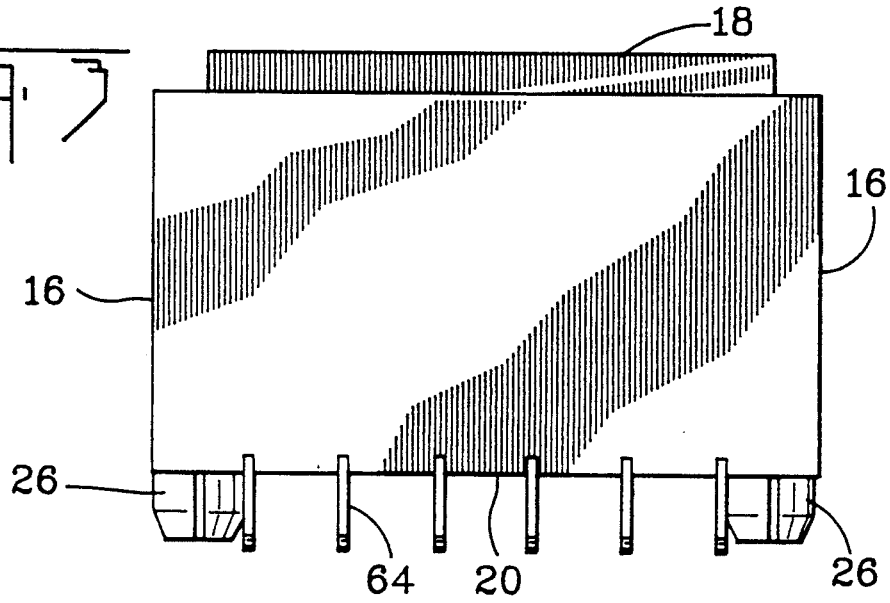
FIG. 3 is a front view of the electrical connector of FIG. 1, with terminals loaded therein.
Figure 4:
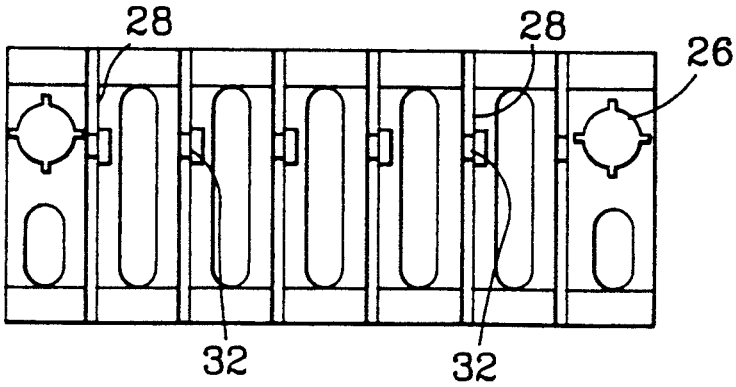
FIG. 4 is a bottom view of the electrical connector according to this invention.

To assemble or load the connector, an insulated conductor 70, having the end stripped 72 to expose the core, see FIGS. 1 and 5, is positioned above the opening 22. Due to the position of the angled leg 54, there is limited resistance in pushing the stripped conductor to the full depth of the slot 48. However, by virtue of legs 54, 56 being positioned to dig into the core of the conductor, any attempt to withdraw the conductor will only result in the terminal digging further into the core, a desirable condition to avoid premature disconnection of the conductor from the connector housing. Accordingly, an externally applied member, such as tool 74 must be used. For example, the tool 74, having a shank of a size to enter into slot 24, where a typical tool 74 is shown in FIG. 1, is inserted into slot 24 to push against angled edge 60 (note the direction arrow in FIG. 5) causing the second leg 54 to pivot slightly (clockwise) about the end 55 thereby moving the intersection 58 out of line from the slot 48. Additionally, it will be recalled that major arm 44 is preferably spaced from the cavity wall 30', a position that will appear for the terminal in the resiled condition. However, as the tool 74 or other extraction member is pushed against the second leg 54, some of the pivotal action will be transferred to major arm 44 which will pivot slightly toward said cavity wall 30' in response to said action. This action essentially creates a free path for removal of the bare core 72 from slot 48. FIG. 6 illustrates the connector in the loaded condition with the second leg 54 digging into core 72 thereby assuring its retention in the connector until extracted, as explained herein. To avoid overstressing the terminal during loading and unloading of the conductors, it will be noted that the end 90 of third leg 56 has a flattened edge 92 which is adapted to abut the edge 94 of first leg 50. This essentially limits the penetration of the tool 74 into the cavity 28, while assuring sufficient movement of second leg 54.

Figure 8:
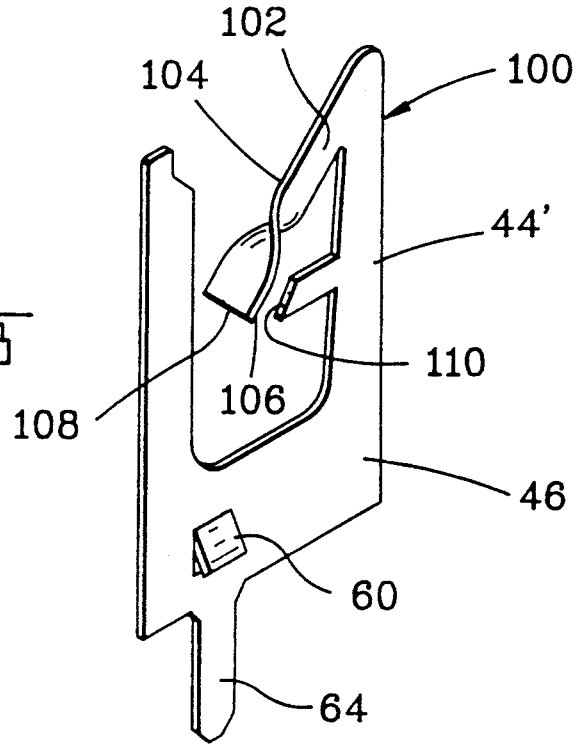
FIG. 8 is a perspective view of an alternate embodiment for the electrical terminal for use in the connector of this invention.

FIG. 7 illustrates the preferred terminal of this invention, while FIG. 8 represents an alternative thereto. For the latter embodiment, the terminal 100 includes a modified leg 102, where the downwardly projecting portion 104 has been modified by the end 106 thereof twisted 90°. By this arrangement, a broad edge 108 is exposed to the stripped conductor to provide improved contact and retention therewith. Finally, to again avoid overstressing the terminal, an abutment 110, projecting from major arm 44', is provided, where such abutment 110 is intended to limit the pivotal movement of the downwardly projecting portion 104.

To review briefly, FIG. 5 shows the position for extracting the conductor from the connector, while FIG. 6 shows the position of a loaded connector, irrespective of the terminal design.

Figure 9:
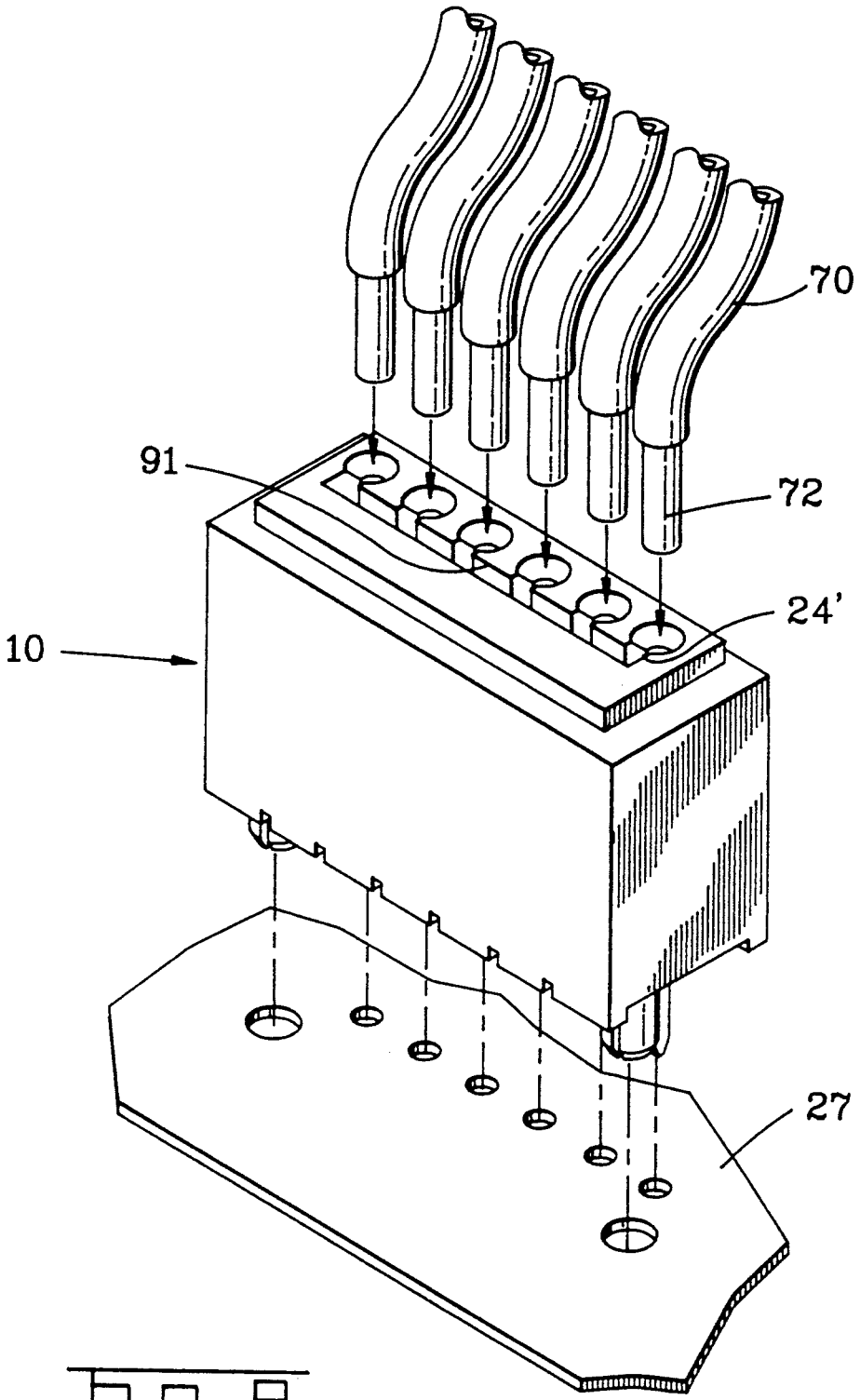
FIG. 9 is a perspective view similar to FIG. 1 showing an alternate preferred embodiment, particularly a modified connector housing for extracting plural stripped conductors in a single operation.

In the alternate preferred embodiment of FIG. 9, the slots 24' are joined by a longitudinal slot 91. By this arrangement, a single, wide blade-type tool, not shown, may be inserted into the slot 91 to allow extraction of all the conductors in a single operation. That is, the blade thereof acts simultaneously against the angled edges 60 of each terminal causing the arms 56 to shift to allow unloading of all conductors 72 from their respective holes 22 and slots 48.

Figure 10:
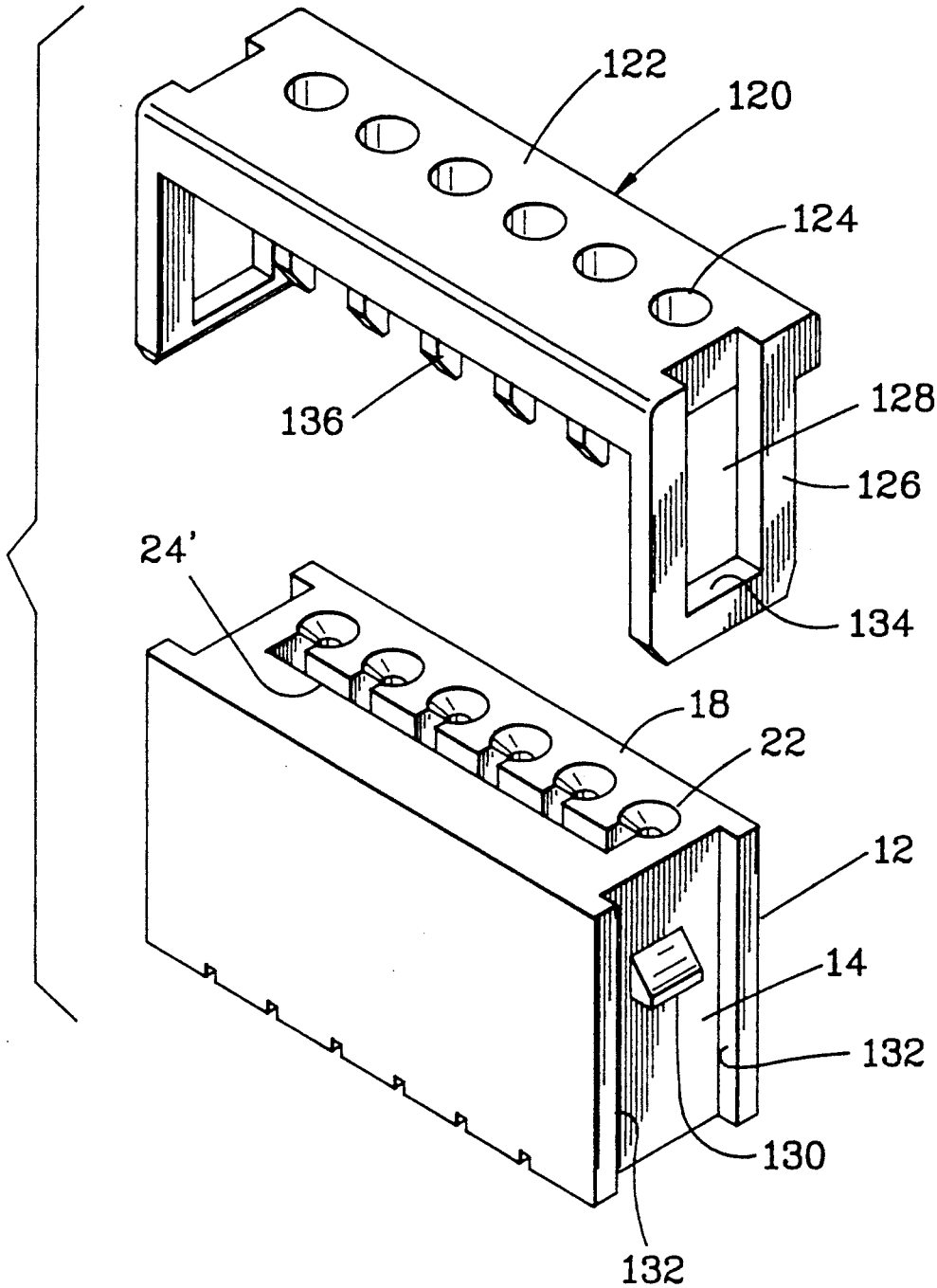
FIG. 10 is an exploded perspective view of the connector housing of FIG. 9, and a conductor extraction cover for mounting thereon.
Figure 11:
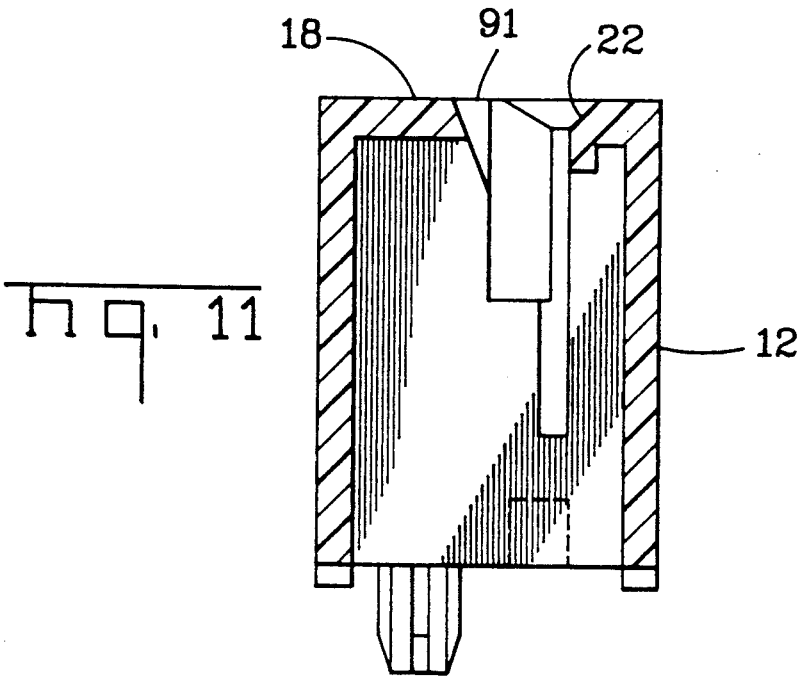
FIG. 11 is a sectional view of the conductor housing of FIG. 9.
Figure 12:
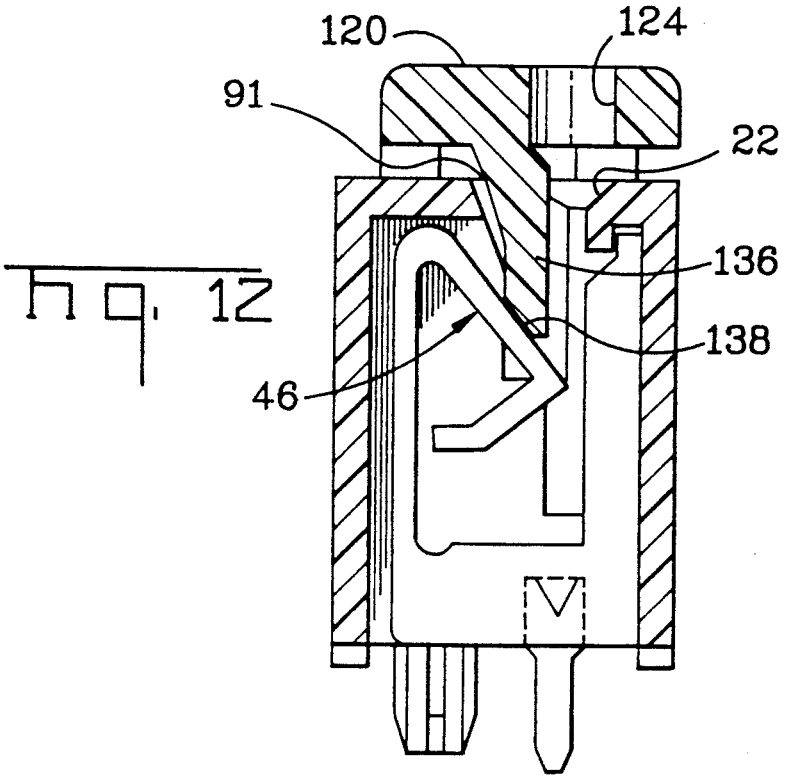
FIG. 12 is a sectional view of the assembled connector housing and cover of FIG. 10.

FIGS. 10–12 illustrate a further embodiment to extract the conductors in a single operation. This approach represents a modification to the invention covered in U.S. Pat. No. 4,981,432, assigned to the assignee of this invention. Briefly, as illustrated in FIGS. 10 and 12, the connector housing 12 may be provided with a cover-like member 120 having a top portion 122 containing a plurality of conductor receiving holes 124, where such holes are aligned with the conductor openings 22 in the housing conductor loading face 18. Projecting downwardly from the top portion 122 are a pair of U-shaped arms 126, where the slot 128 therein is adapted to receive a housing tab 130 along the housing side wall 14. That is, the cover-like member 120 slidably engages the side walls 14, between the vertical ribs 132 by engaging the tabs 130. The cover-like member 120, when so engaged, is movable from a first position where the tab 130 contacts the crossbar 134, to a conductor extracting position where the top portion 122 lies adjacent conductor loading face 18. Projecting below the top portion are a plurality of fingers 136 or arms, as best seen in FIG. 12, which are adapted to be received in the slots 24' and longitudinal slot 91. As the cover-like member 120 is pushed toward and in contact with the conductor loading face 18, the tapered tips 138 of fingers 136 bear against the terminal 40 to clear the conductor for extraction from the connector. Due to the resilient nature of the several terminals, as pressure on the cover-like member is released, the terminals will resile pushing the cover-like member 120 to its uppermost position.

We claim:

1. In an electrical connector of the type allowing for the individual or mass loading and extraction of electrical conductors therefrom, where said connector includes a plurality of cavities therein extending longitudinally between a contact loading face and a conductor receiving face, where said conductor receiving face includes an aligned row of conductor openings of a like plurality communicating with said cavities, and a stamped electrical contact within each said cavity, said contact including a base and a pair of spaced apart arms upstanding therefrom, where the inner edge of a first arm is aligned with its corresponding conductor opening, and the other arm includes an angular extension directed downwardly and toward said first arm, where the end most edge thereof is aligned with and exposed to its corresponding conductor opening, the improvement comprising in combination therewith the provision that each said contact is planarly aligned in a direction transverse to said longitudinal direction, and that said angular extension is arranged to flex within the plane of said contact upon loading and extracting conductors therefrom, and a lateral slot extending from each said conductor opening for receiving an externally applied extraction member, whereby said extraction member may be received in said lateral slot to laterally flex said angular extension to provide a free path for said electrical conductor so as to remove said electrical conductor from contact with said inner edge.

2. The improved electrical connector according to claim 1, wherein each said contact includes a lance projecting therefrom, where said lance is adapted to engage the cavity wall to fixedly engage said contact therewithin.

3. The improved electrical connector according to claim 1, wherein the said other arm of the contact is spaced from the cavity inner wall to allow flexing movement thereof during extraction of the conductor.

4. The improved electrical connector according to claim 1, wherein said lateral slots are joined by a slot longitudinally coextensive with said conductor openings.

5. The improved electrical connector according to claim 4, wherein said extraction member is a bladed tool to be received in said longitudinal slot.

6. The improved electrical connector according to claim 1, wherein the conductor contact portion of said angular extension is a formed arm projecting laterally therefrom to provide a conductor contact edge for engagement with said conductor.

7. The improved electrical connector according to claim 6, wherein said angular extension includes an arm extending from said conductor contact edge toward said other arm to provide a stop thereby limiting the flexing of said angular extension.

8. The improved electrical connector according to claim 1, wherein said angular extension is twisted about 90° to provide a conductor contact edge for engagement with said conductor.

9. The improved electrical connector according to claim 8, wherein said other arm includes a projection extending toward said contact arm to provide a stop thereby limiting the flexing of said angular extension.

* * * * *